United States Patent [19]

Martin

[11] 3,958,712

[45] May 25, 1976

[54] STORAGE AND CARRIAGE BIN

[75] Inventor: James J. Martin, Buena Park, Calif.

[73] Assignee: The Martin Brothers, Toledo, Ohio

[22] Filed: Feb. 7, 1975

[21] Appl. No.: 548,089

[52] U.S. Cl. ..... 217/40; 108/55; 217/17; 217/65; 217/69; 206/386

[51] Int. Cl.[2] ..... B65D 85/34; B65D 9/34; B65D 19/14

[58] Field of Search ..... 217/36, 5, 40, 51, 43, 217/17, 68, 71, 69, 65, 43 A; 108/55 R; 206/386

[56] References Cited

UNITED STATES PATENTS

| | | | |
|---|---|---|---|
| 687,610 | 11/1901 | Davidson | 217/5 |
| 1,152,366 | 8/1915 | Backus | 217/69 |
| 1,609,941 | 12/1926 | Gerding et al. | 217/69 |
| 1,656,161 | 1/1928 | Berndt | 217/69 |
| 1,929,303 | 10/1933 | Brown | 217/5 |
| 2,148,027 | 2/1939 | Lion et al. | 217/69 |
| 2,161,072 | 6/1939 | McKenney | 217/69 |
| 2,700,457 | 1/1955 | Munroe | 217/69 |
| 3,027,038 | 3/1962 | Kordowski | 217/43 A |
| 3,072,278 | 1/1963 | Baxter et al. | 217/43 A |
| 3,342,364 | 9/1967 | Bingham | 217/69 |

FOREIGN PATENTS OR APPLICATIONS

| | | | |
|---|---|---|---|
| 255,997 | 5/1925 | United Kingdom | 217/69 |
| 656,089 | 11/1963 | Belgium | 217/69 |

*Primary Examiner*—William T. Dixson, Jr.
*Assistant Examiner*—Allan N. Shoap
*Attorney, Agent, or Firm*—Francis X. LoJacono, Sr.

[57] ABSTRACT

A storage and carriage bin for use in storing and transporting fruits, vegetables, and various types of industrial equipment. The bin comprises a substantially rectangular container capable of being transported by the well known fork-lift apparatus, said container having a slotted bottom deck supported by a plurality of runners attached thereto. Mounted and secured to the deck are four wall panels arranged in approximate edge-to-edge relationship to each other, and having disposed about the periphery thereof a plurality of twist wires. Each of said wall panels is provided with an upper and a lower longitudinal cleat member having at least one leading edge beveled to insure protection from damage to fruits and vegetables stored therein. Corner brace members are secured to each one of the four corner junctions and are designed to allow the fruits and vegetables to be dumped from the container without damage thereto. Base plates are also provided to insure a rigid construction for the bin.

3 Claims, 7 Drawing Figures

STORAGE AND CARRIAGE BIN

BACKGROUND

1. Field of the Invention

This invention relates generally to storage and carriage bins, and more particularly to a bin designed to receive and transport fruits and vegetables without damage to said produce in the storage and shipping processes.

2. Description of the Prior Art

As is well known in the art, various types of bins and containers are presently available for the purpose of storing and transporting farm products, as well as industrial equipment. However, various problems and difficulties are encountered in providing a container capable of protecting from damage produce such as fruits and vegetables while loading said produce into bins and containers for shipment.

In addition, containers or bins must be so designed that the delicate produce is not injured. As an example, if just a very few lemons should be damaged, the entire load within that particular bin will tend to spoil. Thus, the entire operation can become wasteful and costly.

A further problem exists when the produce is unloaded from a container. Produce is very readily damaged as the fruits or vegetables are dumped from the container or bin; because, generally, the container or bin is very roughly and heavily constructed with protruding ribs, edges, etc., that can damage the produce as it leaves the bin — again, resulting in a very costly operation.

Thus, it is obvious that there is a need in the art to provide a more effective and efficient means by which various farm products can be safely loaded, stored, transported, and thence unloaded.

SUMMARY

This invention provides a means by which farm produce can be loaded, stored, transported and unloaded with a very minimum chance of damage to the items. Thus, herein presented is a storage and carriage bin comprising a rectangular container having a slotted bottom deck, with three support runners secured to the bottom of said deck in a parallel relationship to each other, wherein the first two runners are positioned adjacent opposite edges and the third runner is secured intermediate the first two runners. This, then, forms a pallet-like construction whereby a fork-lift device (pallet truck) can be readily used therewith.

Secured to this pallet-type construction are four individual wall panels having a plurality of twist wires securely bound about the periphery of the rectangularly formed container. Securing the four walls in such a manner eliminates the use of nails which might cause damage to the items stored therein.

Positioned between the deck and the central runner and at opposite ends thereof is a pair of base plates whereby the two front opposing panels are attached and held in place to better carry a load. The two remaining oppositely-disposed panels are so constructed that they extend downwardly over the side runners and are secured thereto by any suitable means.

Each wall panel includes an upper and a lower longitudinal cleat member to add strength and support to the structure. The upper cleats are formed with a beveled lower leading edge, and the lower cleats are provided with a beveled upper leading edge. Hence, farm produce being loaded or unloaded is not exposed to possible damage.

A major element also included in the present invention is a corner brace member. The corner brace is adapted to be fixedly received to the inner upper exposed corner junction of the four wall panels. These corner elements not only provide a structural brace member, but in addition are designed with an outwardly-sloping wall so as to protect produce from damage when it is removed, such as in dumping the contents from the bin.

OBJECTS AND ADVANTAGES

The present invention has for an important object a provision for the loading, storing, transporting and unloading of various farm products without subjecting said products to possible damage.

It is another object of the present invention to provide a storage and carriage bin that is of high quality and strength, but light in weight.

It is still another object of the invention to provide a storage and carriage bin of this type wherein the various fastening means do not protrude within the storage area.

It is a further object of the invention to provide a bin of this character that is simple and rugged in construction.

A still further object of the invention is to provide a bin of this character that can be made available in an assembled or knocked-down mode.

It is still another object of this invention to provide a storage and carriage bin that is easy to service and maintain.

It is still a further object of the invention to provide a bin of this character that is relatively inexpensive to manufacture.

Other characteristics, advantages and objects of this invention can be more readily appreciated from the following description and appended claims. When taking in conjunction with the accompanying drawings, this description forms a part of the specification wherein like references and characters designate corresponding parts in several views.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
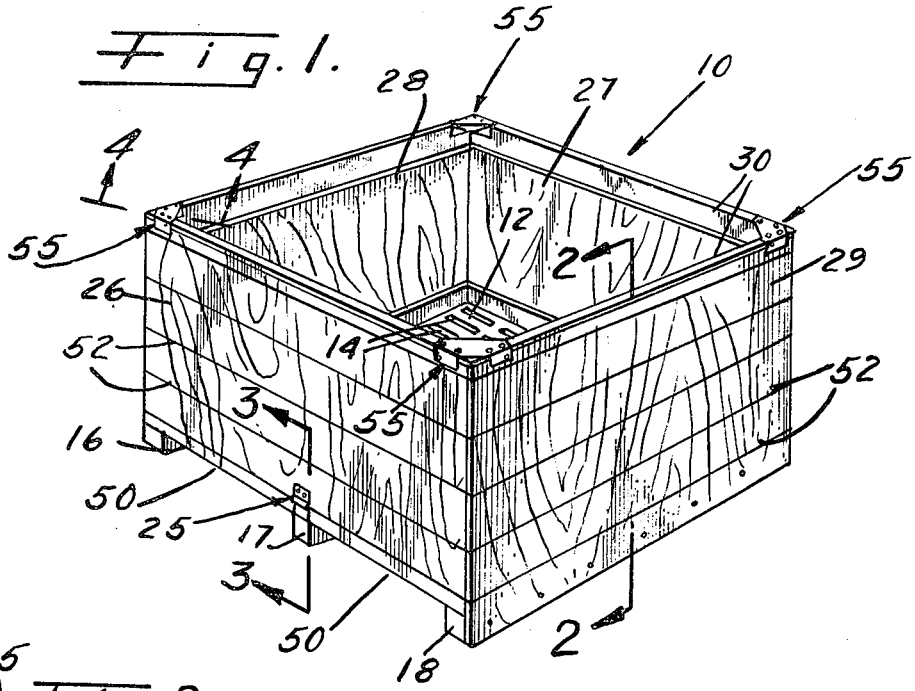
FIG. 1 is a perspective view of the present invention.

Referring to the drawings and more particularly to FIG. 1, the present invention is illustrated as a substantially rectangular bin, generally indicated at 10, adapted for use as a storage and carriage bin or container.

Figure 3:
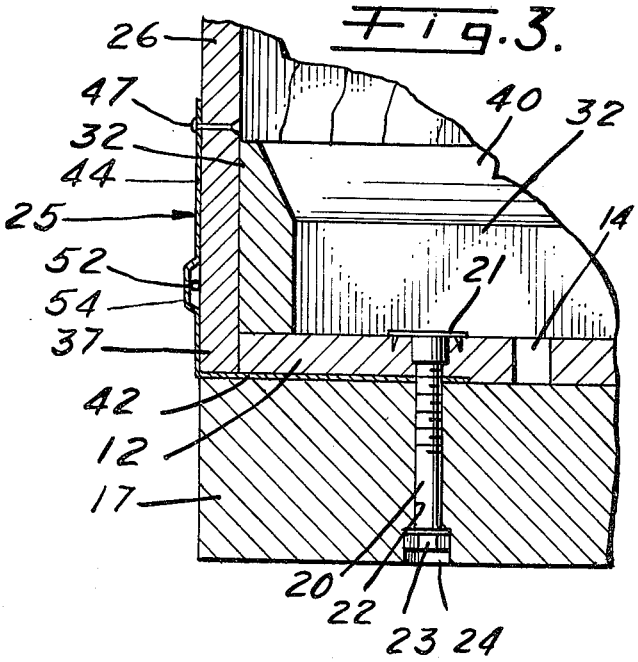
FIG. 3 is an enlarged cross-sectional view taken substantially along line 3—3 of FIG. 1, showing the position of the base plates.

Said bin 10 comprises a bottom flat deck 12 having a plurality of vent slots 14, these slots varying in length depending on the requirements for the use thereof. The deck 12 is generally formed by four equal sides comprising a rectangular configuration. Secured to the bottom face of the deck 12 are three support runners 16, 17 and 18, respectively, each being bolted to the deck by means of bolts 20 and tee-nuts 21, as seen in FIG. 3. The bolts 20 are received in bore 22 wherein the bolt head 23 is counter sunk in hole 24, so that the runner does not have an exposed obstruction, or protrusion.

The tee-nut 21 is well known and it provides the deck 12 with an unobstructed face whereby produce or other easily damaged farm products can not be injured.

Runners 16 and 18 are positioned along opposite edges of the deck 12, with the third runner 17 being positioned intermediate the runners 16 and 18 — all in parallel relationship to each other. At the time the deck and the middle disposed runner 17 are secured together, a base plate, generally indicated at 25 is installed therebetween, as further seen in FIG. 3, said base plate being fully described hereinafter.

Arranged in a contiguous end-to-end manner are four wall panels 26, 27, 28 and 29, respectively, each being substantially equal in size and configuration. However, panels 26 and 27 are slightly shorter in their height compared to panels 28 and 29. For ease in explanation, panels 26 and 27 will be referred to as front wall panels, and panels 28 and 29 will be referred to as side wall panels.

To erect the bin, for example, front panel 26 can be installed first, then side panel 28, followed by front panel 27 and side panel 29 — thereby forming a substantially rectangular bin or container 10.

Figure 2:
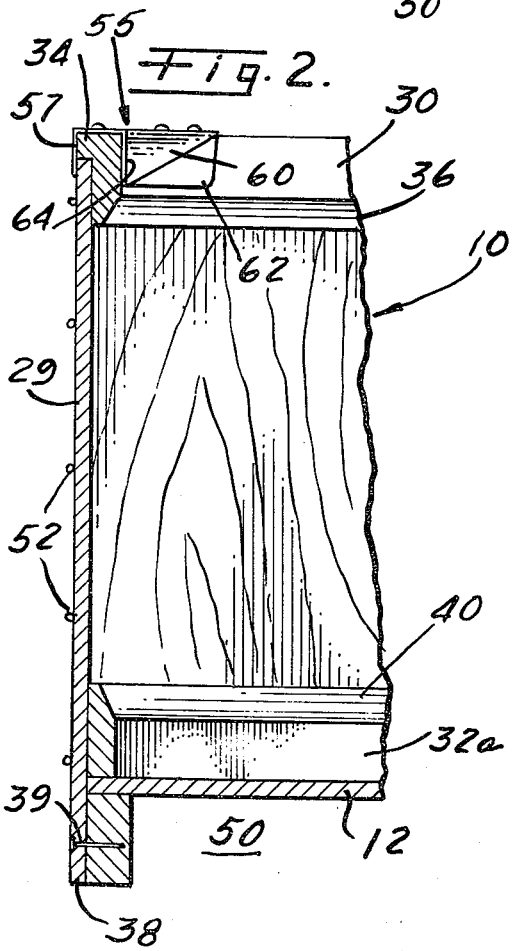
FIG. 2 is an enlarged cross-sectional view taken substantially along line 2—2 of FIG. 1.
Figure 4:
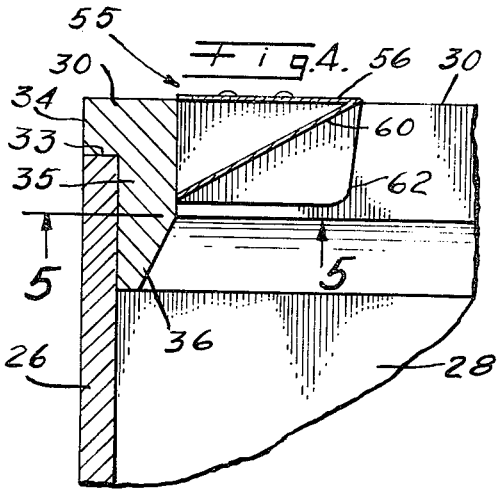
FIG. 4 is, also, an enlarged cross-sectional view taken along line 4—4 of FIG. 1, illustrating the corner brace member as it is secured to a corner junction of the bin.
Figure 8:
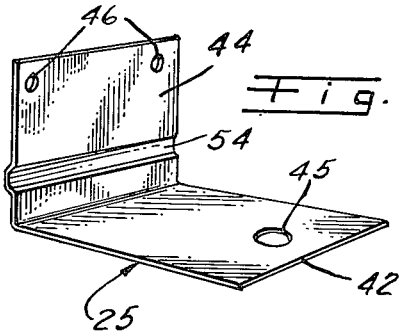

In addition, however, all four panels also include an upper and a lower cleat member 30 and 32, respectively. The upper cleat member 30 is affixed along the longitudinal edge 33 of each wall panel, said cleat having a substantially inverted L-shaped configuration, as seen in FIG. 4. The leg portion 34 extends outwardly, covering the edge 33 of the panel, wherein the main body portion 35 extends downwardly on the inner face of the panel, said main body 35 being inclined downwardly, forming an outer, leading, beveled, longitudinal edge 36. The bottom or lower cleat member is secured just above the lower edge 37 of panels 26 and 27, as seen in FIG. 3. However, the lower cleats indicated at 32a which are secured to panels 29 and 30 are spaced further from the lower edges 38, as seen in FIG. 2. Each lower cleat is formed with an upper, beveled, leading edge 40, said edge being inclined inwardly and upwardly.

Referring again to the installation of the wall panels, panel 26 is so positioned that the lower edge 37 is disposed between the base plate 25 and the edge of the deck 12. Said base plate 25 has an L-shaped configuration wherein the horizontal plate 42 is disposed between the deck 12 and runner 17, and the vertical plate 44 is attached to the outer face of panel 26. Likewise, the oppositely-disposed panel 27 is attached in the same manner. The horizontal plate 42 is provided with an opening 45 through which bolt 20 is received, and the vertical plate 44 is provided with holes 46 through which fastening means, such as rivets 47, are secured. Thus, the base plate 25 establishes a support for the front wall panels 26 and 27.

As can be seen in the drawings, the runners form a pallet-type construction whereby forks of a fork truck or lift can be received in space 50. This creates the need for front panels 26 and 27 to be shorter than the side panels 28 and 29.

Accordingly, side panels 28 and 29 are extended downwardly over the side runners 16 and 18, respectively, and are fastened thereto by fastening means 39, as seen in FIG. 2 — providing a secure mounting for each of said side panels. However, to insure a totally self-contained and rigid structure without protruding fasteners inside the bin area, there is included a peripheral fastening means comprising a plurality of twist wires 52 disposed about the periphery of the four walls, as seen in FIG. 1. In order to accommodate the peripheral wire, the vertical member 44 of the base plate 25 is formed with a horizontal channel 54, whereby a strand of wire 52 passes therethrough. (See FIG. 3.)

Included within the overall invention is a corner brace means, generally indicated at 55, providing a two-fold purpose — the first being to construct a corner brace adapted to be fixedly received over eacch upper corner junction of the bin, forming a very strong foundation to support the panel walls in an end-to-end relationship. The second use for the brace is, also, very important — that is to provide a means by which the stored produce can be emptied from the container without being damaged. Thus, ass the bin is tipped over, the fruits or vegetables will easily slide over the corner brace member 55. This is due to the particular design of the corner brace which will hereinafter be fully described.

Figure 5:
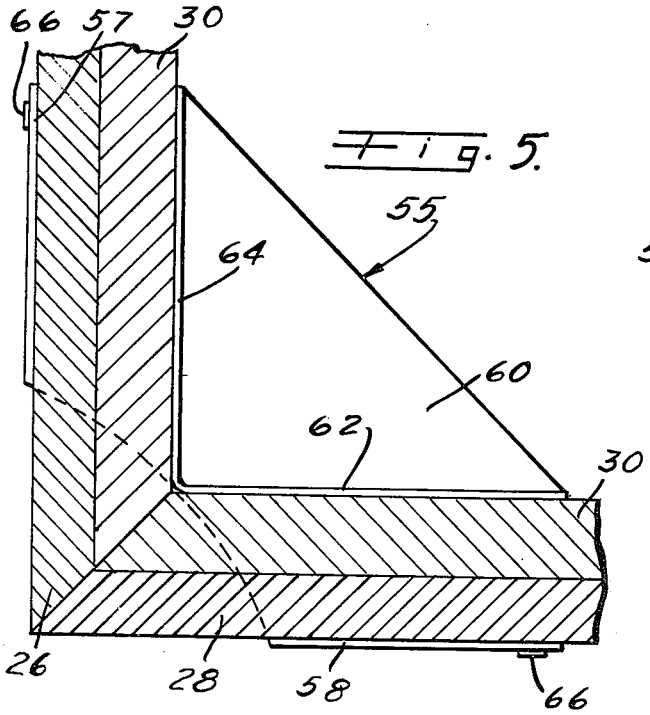
FIG. 5 is an enlarged cross-sectional view taken along line 5—5 of FIG. 4.
Figure 6:
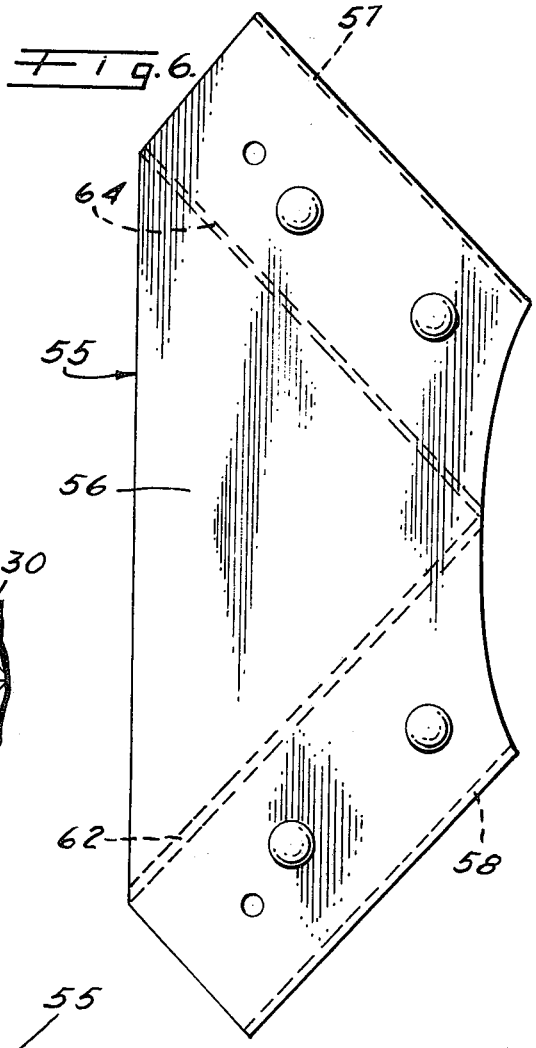
FIG. 6 is a top plan view of the corner brace member.
Figure 7:
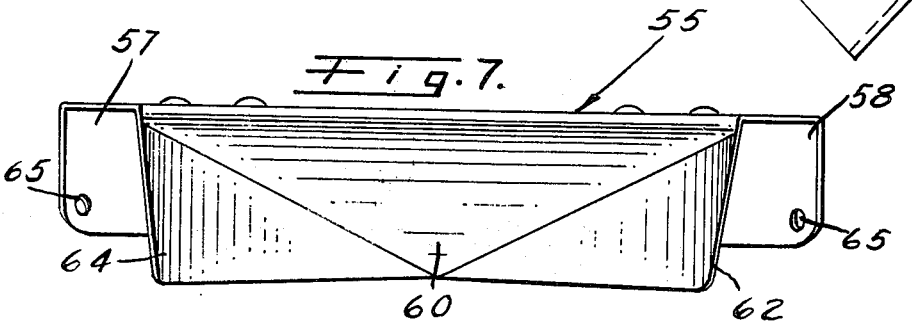
FIG. 7 is a front elevational view thereof.

The corner brace member 55 is formed from a flat sheet of metal. This sheet is stamped to comprise a substantially-flat truss-like member 56 which, when in place, traverses the corner of the bin, contacting each adjacent wall panel. Downwardly-bent, depending, flange members 57 and 58 are formed as outer ribs which are disposed at 45 degrees to the length of the truss member 56. Member 56 is also bent backward, as at 60, providing an inwardly and downwardly inclined partition. This partition 60 has formed along the edges thereof oppositely-arranged, inner, rib members 62 and 64. As can be seen in FIGS. 5 and 6, the inner ribs 62 and 64 are depending downwardly in a parallel relationship to respective outer ribs 57 and 58, thus providing two channels disposed at right angles to each other. The upper adjacent edges of the wall panels are readily received therein, as seen in FIG. 5.

Ribs 57 and 58 each include at least one opening 65 therein to allow fastening means, such as rivets 66, to be secured to respective walls, thereby fixedly attaching the brace 55 to the bin 10. In addition, holes 67 are also located in the truss member 56 in order to receive other fastening devices, if needed.

Hence, it can be understood that the corner braces provide the two functions, as previously mentioned.

The invention and its attendant advantages will be understood from the foregoing description, and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form or uses mentioned, except as defined in the accompanying claims.

I claim:

1. A storage and carriage bin forming a substantially rectangular container for farm produce, comprising:

a slotted bottom deck;

a plurality of parallel runners secured to the underside of said bottom deck;

a pair of side wall panels positioned in parallel relationship to said runners;

a pair of front wall panels transversely positioned to said parallel runners, wherein said side and front wall panels are arranged in a contiguous end-to-end relationship to each other, each panel thereof having an upper free edge;

a pair of base plates secured between said bottom deck and one of said runners, and wherein each base plate is positioned adjacent each respective front wall panel and secured thereto;

a plurality of corner brace members secured at each intersection of each side and front wall panel forming corners in said container;

an upper longitudinal cleat member secured to each of said wall panels along said upper free edge thereof, said cleat having at least one beveled, longitudinal, leaving edge thereon, and a protective longitudinal edge disposed over the peripheral edge of each wall panel, whereby said panels are protected from damage;

a lower longitudinal cleat member secured to each of side wall panels adjacent the bottom deck and having at least one beveled, longitudinal, leading edge thereon;

a plurality of longitudinal twist wires mounted to the periphery of said wall panels, whereby said panels are secured in an end-to-end manner;

a pallet means comprising said runners and said bottom deck; and wherein said side wall panels extend downwardly, forming an overlapping extended portion, said extended portion being secured to said runners, providing a positive interconnecting structure, whereby the lifting force applied to said bin is absorbed evenly throughout the interconnected structure; and wherein said front panels terminate above said runners, providing an opening between said runners, forming said pallet means.

2. A storage and carriage bin as recited in claim 1, wherein said corner brace member comprises:

a substantially-flat truss-like member;

a pair of channels disposed at right angles to each other, to receive said upper free edges of said panels; and an inclined partition depending downwardly and inwardly from said truss member, whereby said farm produce is protected from damage while being dumped from said container.

3. A storage and carriage bin as recited in claim 2, wherein said base plate comprises a substantially L shaped member having a horizontal plate including at least one opening disposed therein, and an integral vertical plate having a horizontal channel formed therein, whereby said twist wire passes therethrough, said vertical plate including at least one hole disposed therein, said base plate being centrally secured to each of said front wall panels and to the ends of one of said runners that is centrally aligned therewith.

* * * * *